US007281358B2

(12) United States Patent
Floyd

(10) Patent No.: US 7,281,358 B2
(45) Date of Patent: Oct. 16, 2007

(54) ROOFING SHINGLE

(76) Inventor: Charles T. Floyd, 121 Grosvenor Dr., Raleigh, NC (US) 27615

( * ) Notice: Subject to any disclaimer, the term of this patent is extended or adjusted under 35 U.S.C. 154(b) by 149 days.

(21) Appl. No.: 11/058,890

(22) Filed: Feb. 16, 2005

(65) Prior Publication Data

US 2006/0032174 A1 Feb. 16, 2006

Related U.S. Application Data

(60) Provisional application No. 60/601,822, filed on Aug. 16, 2004.

(51) Int. Cl.
*E04D 1/00* (2006.01)

(52) U.S. Cl. ..... 52/518; 52/537; 52/302.1; 52/540; 52/545

(58) Field of Classification Search ..... 52/518, 52/537, 540, 545, 551, 554, 302.1, 302.3; 428/143, 182

See application file for complete search history.

(56) References Cited

U.S. PATENT DOCUMENTS 1,447,290 A 3/1923 Fischer
1,549,263 A 8/1925 Johnston
2,139,820 A * 12/1938 Graham ..... 52/557
2,140,691 A 12/1938 Crump
2,288,072 A * 6/1942 Collins ..... 264/116
3,377,762 A 4/1968 Chalmers et al.
3,468,092 A * 9/1969 Chalmers ..... 52/543
3,607,529 A 9/1971 Chalmers et al.
3,613,328 A * 10/1971 Callahan ..... 52/555
3,624,975 A * 12/1971 Callahan ..... 52/105
3,973,369 A 8/1976 Smith
4,610,902 A * 9/1986 Eastman et al. ..... 428/57
4,717,614 A * 1/1988 Bondoc et al. ..... 428/143
4,856,251 A * 8/1989 Buck ..... 52/553
5,181,361 A * 1/1993 Hannah et al. ..... 52/535
5,950,387 A * 9/1999 Stahl et al. ..... 52/559
6,708,456 B2 3/2004 Kiik et al.
6,936,329 B2 * 8/2005 Kiik et al. ..... 428/141
6,990,779 B2 * 1/2006 Kiik et al. ..... 52/554

OTHER PUBLICATIONS

City of Bloomington Minnesota, Asphalt Roofing Shingles, Information Sheet, 2004, 4 pgs.

* cited by examiner

*Primary Examiner*—Basil Katcheves
(74) *Attorney, Agent, or Firm*—Adams Evans P.A.

(57) ABSTRACT

A roofing system having shingles. The shingles include a front side, a back side, a pair of spaced-apart side edges, and spaced-apart top and bottom edges, an adhesive, and a backing material. The adhesive is applied to a portion of the shingle for affixing the backing material to the shingle and covering a portion of the back side.

10 Claims, 6 Drawing Sheets

ROOFING SHINGLE

This application claims the benefit of Provisional Application No. 60/601,822 filed on Aug. 16, 2004.

TECHNICAL FIELD AND BACKGROUND OF THE INVENTION

The present invention relates generally to roofing systems and, more particularly, to a roofing system having composite shingles.

Typically, prior art sloped roofing systems include a layer of loose felt paper that covers the roof to prevent shingle heat damage and deterioration where shingles contact each other or the roof underlayment directly. In particular, asphalt shingles will deteriorate due to heat damage if no backing material, such as felt paper, is positioned between roofing shingles and the roof surface. However, the loose felt paper sheets are slippery and present a hazard to roofers walking thereon during shingle installation. Also, multiple steps of applying the felt paper first and secondarily applying shingles thereover, requires additional time and cost.

The prior art has attempted to attach a felt backing on individual shingles, but problems associated with the attachment of the felt were introduced thereby. By way of example, U.S. Pat. No. 3,973,369 provides a roofing shingle having apertures formed therein. A felt backing is affixed with an adhesive to a top region of the shingle with an opening at the lower portion, forming an air pocket to permit water drainage. The particular patterning of the adhesive is essential for the water drainage; without it, roofing leakage or molding would occur.

Thus, there remains a need for a composite shingle having its own backing material with minimal adhesive application to optimize heat dissipation while ensuring integral shingle construction.

BRIEF SUMMARY OF THE INVENTION

Accordingly, it is an object of the invention to provide a composite shingle for roofing systems having a backing material affixed to the back side of each shingle for safe and easy installation.

It is another object of the invention to affix the backing material to the back side of each shingle in a predetermined pattern across a substantially horizontal or width direction of the shingle above or at a portion of the tab region of the shingle.

It is another object of the invention to provide integral composite shingles and roofing systems made with a backing material.

It is another object of the invention to provide a composite shingle for roofing systems having a backing material affixed to the back side of each shingle with an adhesive in a predetermined pattern across a substantially horizontal or width direction of the shingle above or at an upper portion of the tab region of the shingle.

It is another object of the invention to provide a roofing system made with integral composite shingles having a backing material affixed to the back side of each shingle for safe and easy installation.

These and other objects of the present invention are achieved in the preferred embodiments disclosed below by providing a shingle including a front side, a back side, a pair of spaced-apart side edges, and spaced-apart top and bottom edges; an adhesive applied to a portion of the shingle; and a backing material affixed by the adhesive to the shingle for covering a portion of the back side.

According to another preferred embodiment of the invention, the adhesive is applied to the shingle in a substantially horizontal pattern extending between the spaced-apart side edges.

According to another preferred embodiment of the invention, the adhesive is applied to the back side along at least one tab.

According to another preferred embodiment of the invention, the adhesive is applied in a pattern having non-adhesive areas for providing air pockets.

According to another preferred embodiment of the invention, the adhesive is applied to the back side along the top edge.

According to another preferred embodiment of the invention, the adhesive is applied to the front side along the top edge.

According to another preferred embodiment of the invention, the adhesive is selected from the group consisting of polyethylene, polyethylene-vinyl acetate, polypropylene, polyvinylidene chloride, nylon, polyester, and asphalt-type adhesive.

According to another preferred embodiment of the invention, the backing material is made of a flexible sheet material selected from the group consisting of felt paper, reinforced felt paper, and asphalt saturated felt paper.

According to another preferred embodiment of the invention, the backing material is made of a synthetic sheet material containing materials selected from the group consisting of fiberglass, polypropylene, and plastic fibers.

According to another preferred embodiment of the invention, the backing material has air gaps incorporated into the material to provide ventilation.

According to another preferred embodiment of the invention, the backing material is selected from the group consisting of a corrugated material, a mesh material, and a webbed material.

According to another preferred embodiment of the invention, a shingle includes a front side, a back side, a pair of spaced-apart side edges, spaced-apart top and bottom edges, and a plurality of tabs; an adhesive applied to a portion of the front side along the top edge; and a backing material affixed by the adhesive along the top edge of the front side, the backing material being folded over the top edge and positioned for covering a portion of the back side.

According to another preferred embodiment of the invention, the backing material is corrugated.

According to another preferred embodiment of the invention, the backing material is a mesh.

According to another preferred embodiment of the invention, a shingle includes a front side, a back side, a pair of spaced-apart side edges, spaced-apart top and bottom edges, and a tab; an adhesive applied to a portion of the shingle where the shingle does not make contact with a sheathing board; and a backing material affixed by the adhesive to the shingle for covering a portion of the back side.

BRIEF DESCRIPTION OF THE DRAWINGS

Some of the objects of the invention have been set forth above. Other objects and advantages of the invention will appear as the invention proceeds when taken in conjunction with the following drawings, in which.

DETAILED DESCRIPTION OF THE PREFERRED EMBODIMENTS

Figure 1:
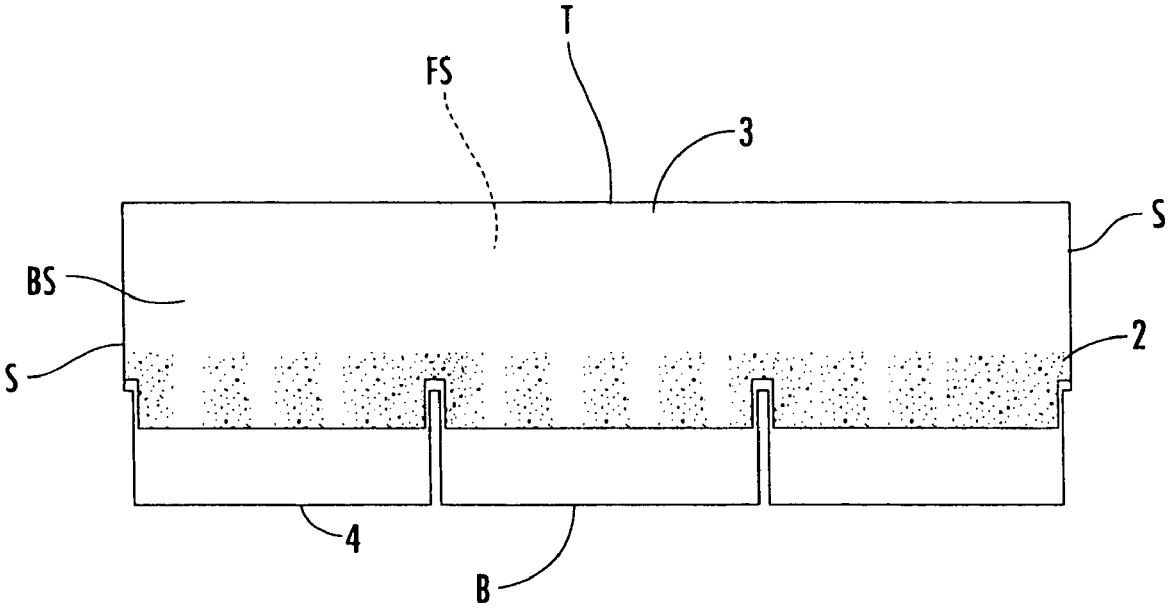
FIG. 1 is a back side view of a shingle constructed according to an embodiment of the present invention.

In the following description, like reference characters designate like or corresponding parts throughout the several views. Also, in the following description, it is to be understood that such terms as "forward," "rearward," "front," "back," "right," "left," "downwardly," and the like are words of convenience and are not to be construed as limiting terms.

Referring now to the drawings in general, the illustrations are for the purpose of describing the invention and are not intended to limit the invention thereto. FIG. 1 illustrates a back side view of a roofing shingle body including a face side "FS" and a back side "BS", spaced-apart top and bottom edges "T" and "B" respectively, and two spaced-apart side edges "S". In the illustrated example, the shingle 4 includes three tabs located adjacent to the bottom edge B. The number of tabs may be varied to suit a particular application. Some shingles may have a single continuous section which has simulated tabs, but no actual separations. The roofing shingle 4 shown in the figures illustrates a three tab shingle; however, a two or three tab shingle may be used in preferred embodiments of the present invention. A backing material 3 is affixed with an adhesive 2 to the back side of the shingle body, covering most of the back side. The tab is partially covered by the backing material 3 at the upper portion of the tab area, as shown in FIG. 1. In the illustrated example, the adhesive application is applied substantially horizontally to the back side; however, the pattern may include some gaps or spaces to reduce the overall amount of adhesive used. The non-adhesive areas between the shingle and the backing material provide air pockets for permitting heat to disperse and to insulate the shingle from the heat of the roof sheathing.

Any adhesive which will secure the backing material 3 to the shingle may be used. Examples of suitable adhesives include low density polyethylene, high density polyethylene-vinyl acetate, polypropylene, polyvinylidene chloride, nylon, polyester, asphaltic adhesive, and combinations or mixtures thereof.

Examples of suitable backing materials include felt paper or flexible synthetic sheet material, preferably comprising polypropylene, high strength polypropylene, fiberglass, reinforced felt paper, asphalt saturated felt paper or a mesh, webbing or corrugate material comprising of fiberglass, plastic fibers, coated fibers or plastic corrugated board.

Figures 2, 2A, 2B:
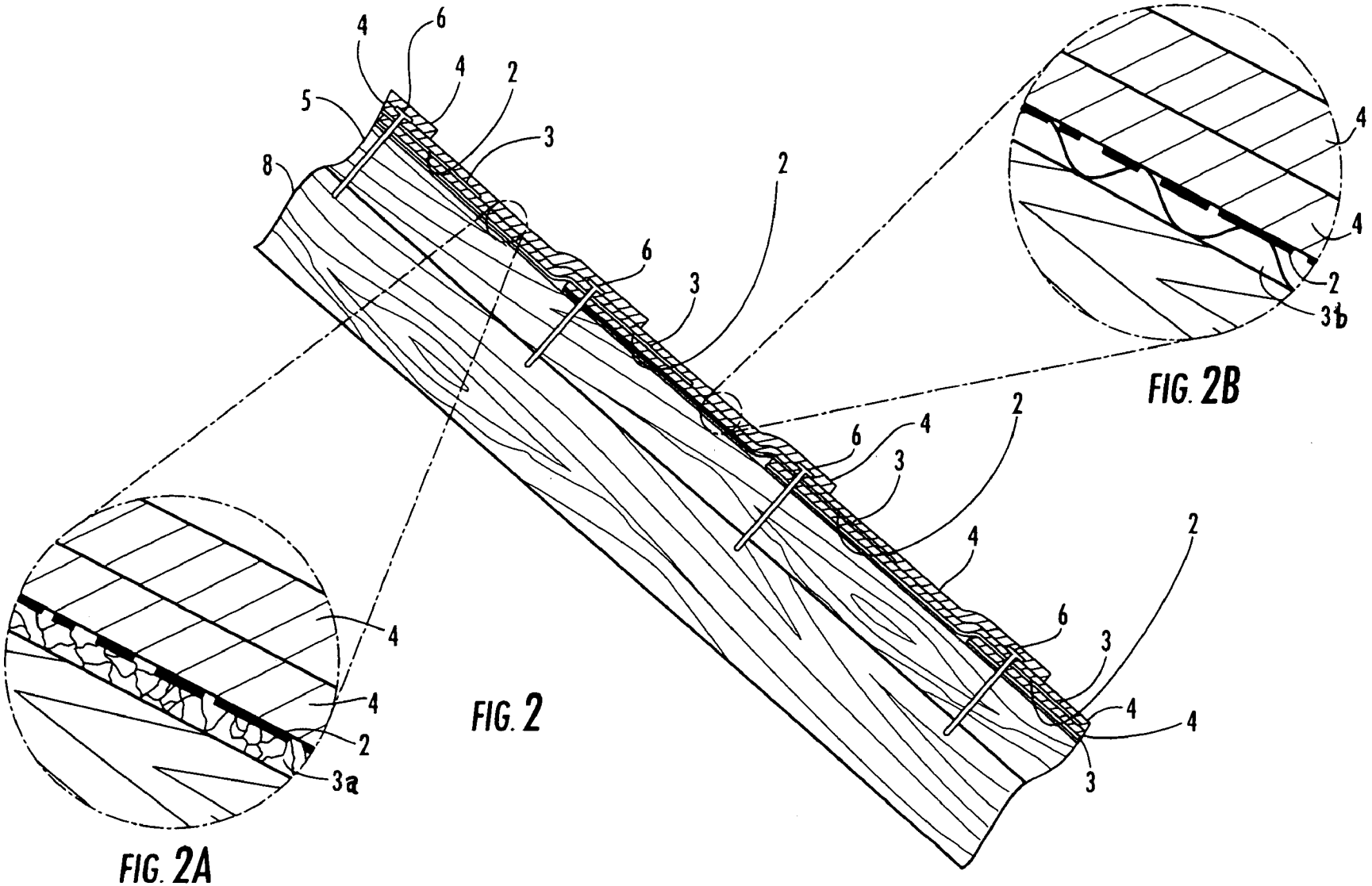
FIG. 2 is a side sectional view showing shingles of FIG. 1 applied to a roof to form a roofing system.
FIG. 2*a* is an enlarged view of the shingles shown in FIG. 2 illustrating a corrugated backing material.
FIG. 2*b* is also an enlarged view of the shingles shown in FIG. 2 illustrating a mesh backing material.

FIG. 2 shows a plurality of the shingles 4 of FIG. 1 attached in an overlapping manner to form a roofing system, with the tab portion of each shingle 4 overlapping onto a top portion of the next shingle 4. The shingles 4 are attached to a roof surface sheathing board 5 by nails 6 or other suitable fasteners. The roofing sheathing board 5 is supported by rafter 8. When applied in a shingle overlap roofing system, the roof sheathing 5 does not touch the area of the composite shingle 4 where the backing 3 is glued to the shingle 4; therefore, no direct thermal path exists between the shingle 4 and the roof, i.e., an insulating or heat dissipating effect is created by the air pockets due to the particular method of affixing the backing material 3 to the shingle body. FIG. 2A shows the backing in the form of a mesh 3*a* and FIG. 2B a corrugated material 3*b*.

Figure 3:
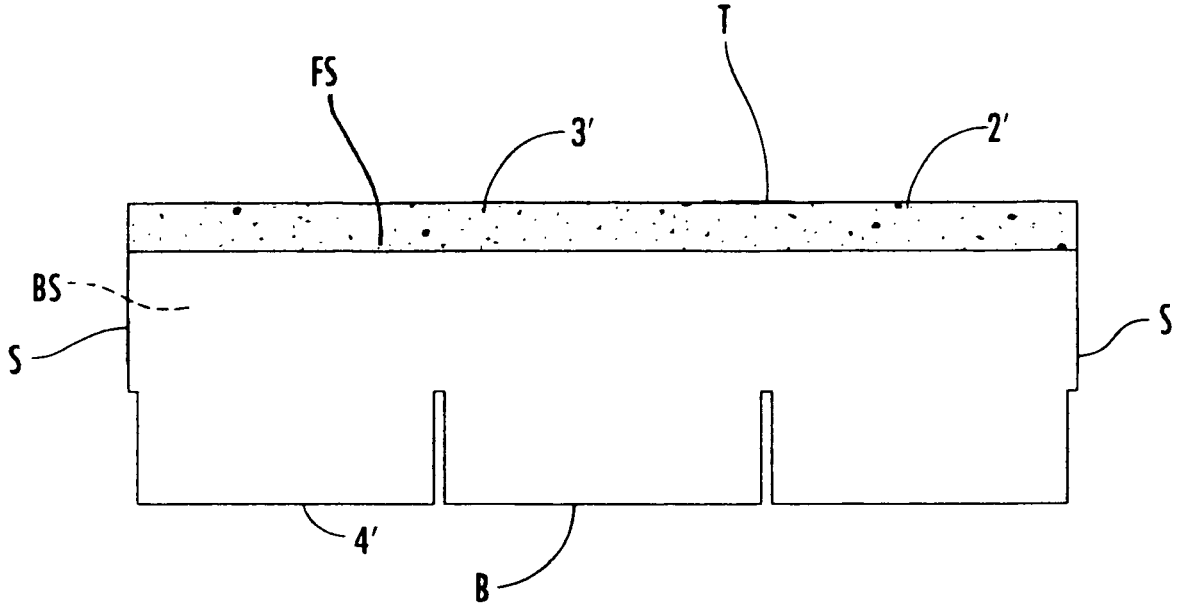
FIG. 3 is a front side view of a shingle constructed according to another embodiment of the present invention.

FIG. 3 illustrates a front side view of an alternative shingle 4'. The backing material 3' is disposed on the back of the shingle 4' and includes an overlapping portion folded-over on the top edge onto the face side of the shingle body and secured with adhesive 2' applied to the face of the top of the shingle body. Examples of material suitable for the backing material and adhesive are noted above. This embodiment may be particularly useful in the case where a flexible synthetic sheet material is used instead of felt paper, such as with a non-woven or film type material.

The adhesive strip 2' disposed on the shingle face side minimizes or eliminates other adhesive application requirements to the back side of the shingle 4', which creates additional air pocket spacing. The adhesive 2' is applied in a substantially horizontal pattern across the width, from side edge to side edge of the shingle 4'.

Figure 4:
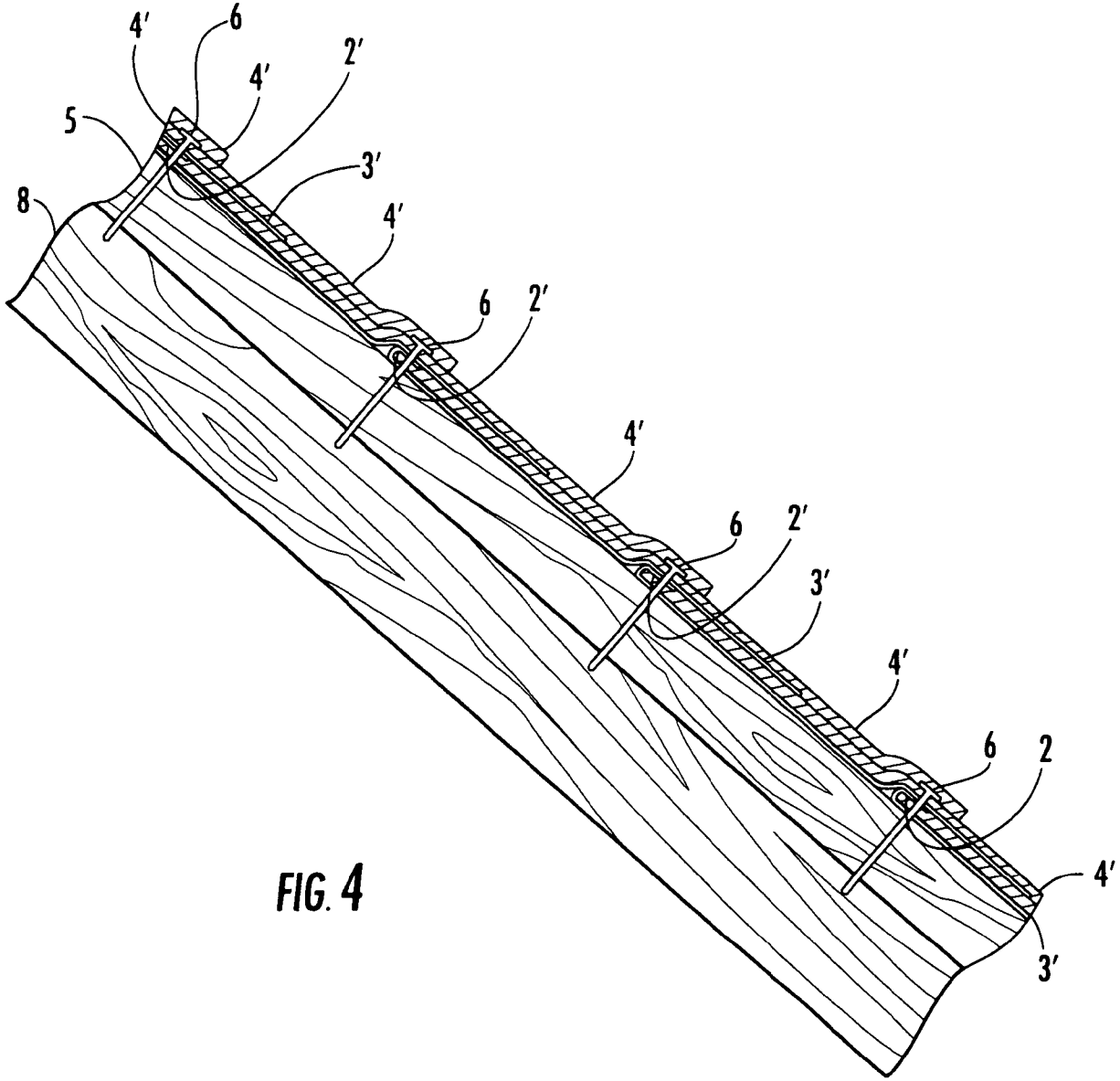
FIG. 4 is a side sectional view showing shingles of FIG. 3 applied to a roof to form a roofing system.

As illustrated in FIG. 4, a plurality of the shingles 4' of FIG. 3 are attached in an overlapping manner to form a roofing system, with the tab portion of each shingle 4' overlapping onto a top portion of the next shingle 4'. The shingles 4' are attached to a roof surface sheathing board 5 by nails 6 or other suitable fasteners. The roofing sheathing board 5 is supported by rafter 8. When applied in a shingle overlap roofing system, the roof sheathing 5 does not touch the area of the composite shingle 4' where the backing material 3' is glued to the shingle 4', therefore, no direct thermal path exists between the shingle 4' and the roof, i.e., an insulating or heat dissipating effect is created by the air pockets due to the particular method of affixing the backing material 3' to the shingle body.

Figure 5:
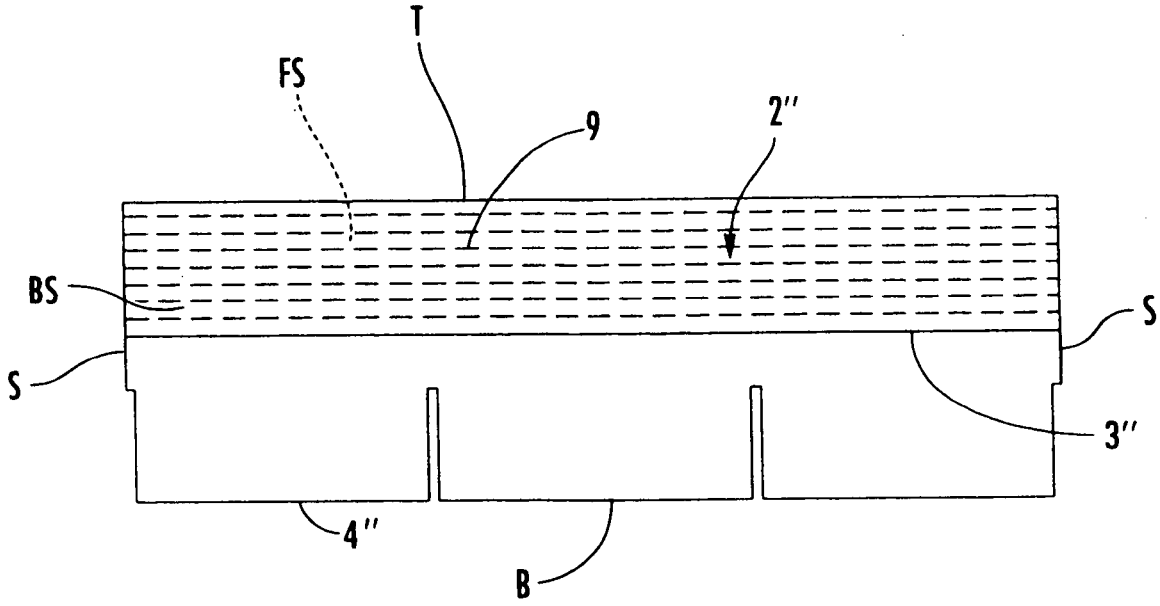
FIG. 5 is a back side view of a shingle constructed according to another embodiment of the present invention.

FIG. 5 illustrates a back side view of another alternative shingle 4". A backing material 3" is applied and affixed to the underside or back of the shingle 4". The backing material 3" is a ventilating material such as a webbing, mesh or corrugated structure. Any of which provides air pockets between the shingle 4" and the sheathing board 5 to allow ventilation air to flow between the shingle 4" and the sheathing 5 may be used. Thus, the backing material 3" allows an adhesive to be applied to a portion of the shingle 4" which is positioned on the sheathing 5.

An adhesive 2" is applied to the back of the shingle 4" within all or part of an area defined by the backing material 3" for affixing the backing material 3" to the back side of the shingle 4". Examples of materials suitable for the adhesive are noted above. The backing material 3" incorporates channels 9 to provide an insulating barrier that can ventilate heat away from the shingle 4", allowing the adhesive 2" to be applied to the shingle 4" in an area where the backing material 3" makes contact with the sheathing board 5 without forming a direct thermal path between the shingle 4" and the sheathing 5.

Figure 6:
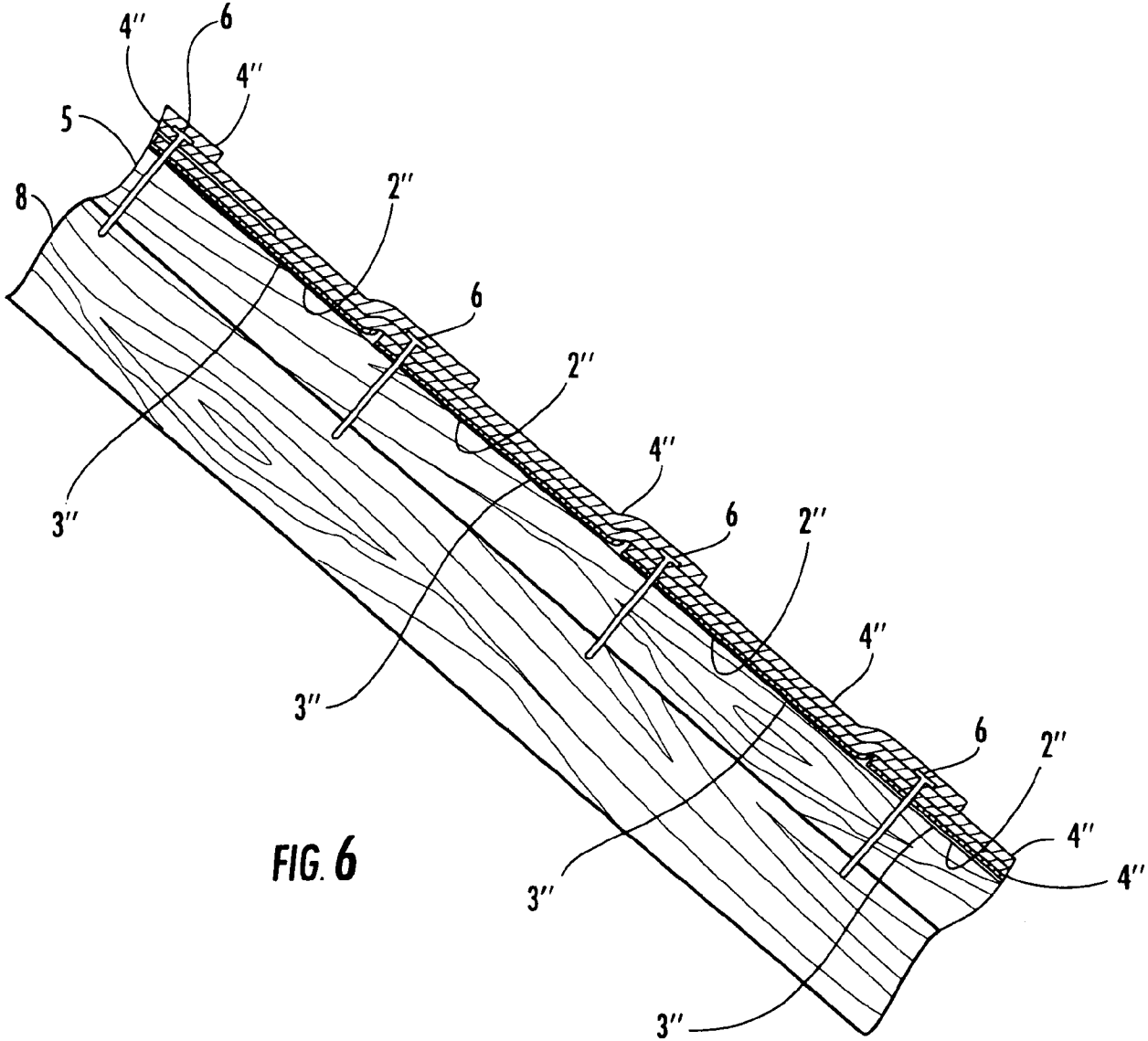
FIG. 6 is a side sectional view showing shingles of FIG. 5 applied to a roof to form a roofing system.

As shown in FIG. 6, a plurality of the shingles 4" of FIG. 5 are attached in an overlapping manner to a roof surface sheathing board 5 to form a roofing system.

The foregoing has described a roofing shingle. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

I claim:

1. A roofing shingle for disposition aside like shingles in overlapping courses on the top of a structure for protecting the structure, the shingle comprising:

(a) a generally rectangular, asphaltic body including a front side, a back side, a pair of spaced-apart side edges, and spaced-apart top and bottom edges;

(b) a corrugated-piece of backing material sized to span from one edge generally adjacent one of the spaced-apart side edges of the shingle body to another edge generally adjacent the other of the spaced-apart side edges of the shingle body, the backing material covering a portion of the back side of the body; and (c) an adhesive between the backing material and the body, wherein the adhesive is applied to the top of the front side of the body and the corrugated material is folded over the top edge to cover the portion of the back side of the body.

2. The shingle according to claim 1, wherein the adhesive is applied to the shingle in a substantially horizontal pattern extending between the spaced-apart side edges.

3. The shingle according to claim 1, wherein said body defines at least one tab, and wherein the adhesive is applied to the back side along at least one of the tabs.

4. The shingle according to claim 1, wherein the adhesive is applied in a pattern having non-adhesive areas for providing air pockets between the backing material and the body.

5. The shingle according to claim 1, wherein the adhesive is selected from the group consisting of polyethylene, polyethylene-vinyl acetate, polypropylene, polyvinylidene chloride, nylon, polyester, asphalt-type adhesive, and combinations thereof.

6. The shingle according to claim 1, wherein the backing material is made of a flexible sheet material selected from the group consisting of felt paper, reinforced felt paper, asphalt saturated felt paper, and combinations thereof.

7. The shingle according to claim 1, wherein the backing material is made of a synthetic sheet material containing materials selected from the group consisting of fiberglass, polypropylene, plastic fibers, and combinations thereof.

8. The shingle according to claim 1, wherein the backing material has air gaps incorporated therein the material to provide ventilation.

9. The shingle according to claim 1, wherein the backing material is made of a flexible sheet material selected from the group consisting of felt paper, reinforced felt paper, asphalt saturated felt paper, and combinations thereof.

10. A roofing system comprising:

(a) a roof sheathing;

(b) a plurality of shingles on the sheathing, each shingle comprising:

(i) a body including a front side, a back side, a pair of spaced-apart side edges, and spaced-apart top and bottom edges;

(ii) a backing material covering a portion of the back side of the body; and (iii) an adhesive applied between the backing material and the shingle body in an adhesive pattern including non-adhesive areas for providing air pockets between the backing material and the body, wherein the adhesive is applied only along the top of the front side of the shingle body and the backing material is folded over the top edge of the shingle body; and (c) a plurality of nails securing the shingles in overlapping courses to the roof sheathing.

* * * * *